US010539022B2

(12) United States Patent
Choi

(10) Patent No.: US 10,539,022 B2
(45) Date of Patent: Jan. 21, 2020

(54) BUCKET ASSEMBLY FOR REPLACING OLD BUCKET PROVIDED WITH TURBINE AND METHOD FOR REPLACING THE SAME

(71) Applicant: DOOSAN HEAVY INDUSTRIES & CONSTRUCTION CO., LTD., Changwon-si, Gyeongsangnam-do (KR)

(72) Inventor: Sung Man Choi, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 1063 days.

(21) Appl. No.: 14/757,533

(22) Filed: Dec. 23, 2015

(65) Prior Publication Data

US 2016/0186569 A1 Jun. 30, 2016

(30) Foreign Application Priority Data

Dec. 24, 2014 (KR) ..... 10-2014-0188544

(51) Int. Cl.
*F01D 5/00* (2006.01)
*F01D 5/30* (2006.01)
*F01D 11/00* (2006.01)

(52) U.S. Cl.
CPC ..... *F01D 5/005* (2013.01); *F01D 5/3053* (2013.01); *F01D 11/008* (2013.01); *F05D 2220/31* (2013.01); *F05D 2230/10* (2013.01); *F05D 2230/60* (2013.01); *F05D 2230/80* (2013.01); *F05D 2240/30* (2013.01); *F05D 2240/80* (2013.01)

(58) Field of Classification Search
CPC ..... F01D 11/008; F01D 5/005; F01D 5/3046; F01D 5/3053; F05D 2220/31; F05D 2230/10; F05D 2230/60; F05D 2230/80; F05D 2240/30; F05D 2240/80
USPC ..... 416/214 A, 215, 218
See application file for complete search history.

(56) References Cited

U.S. PATENT DOCUMENTS 1,345,678 A * 7/1920 Kasley ..... F01D 5/3046 416/218
1,362,074 A * 12/1920 Baumann ..... F01D 5/021 416/214 A (Continued)

FOREIGN PATENT DOCUMENTS

JP 57119106 A 7/1982
JP 20008807 A 1/2000

(Continued)

*Primary Examiner* — Mark A Laurenzi
*Assistant Examiner* — Paul W Thiede
(74) *Attorney, Agent, or Firm* — Invenstone Patent, LLC

(57) ABSTRACT

A bucket assembly for replacing an old bucket is provided with a turbine and a method for replacing the same. The bucket to be replaced is removed and then the bucket assembly configured of a blade part, first and second dovetail members, and a coupling member is simply assembled in a male dovetail, without sequentially disassembling the already installed buckets though a notch opening upon replacing the damaged bucket among the already installed buckets in a tangential entry type dovetail, thereby shortening replacement time and replacement costs of the bucket assembly and preventing a secondary damage occurring to the rotor or the rotor wheel during the disassembling process.

13 Claims, 10 Drawing Sheets

(56) References Cited

U.S. PATENT DOCUMENTS

| | | | | |
|---|---|---|---|---|
| 5,405,244 | A | 4/1995 | Boyd | |
| 2015/0078904 | A1* | 3/2015 | Kazirskis | F01D 5/02<br>416/213 R |

FOREIGN PATENT DOCUMENTS

| | | | |
|---|---|---|---|
| JP | 2004156441 | A | 6/2004 |
| JP | 2006336656 | A | 12/2006 |
| JP | 2011220325 | A | 11/2011 |
| JP | 2013-19395 | A | 1/2013 |

* cited by examiner

Related Art

BUCKET ASSEMBLY FOR REPLACING OLD BUCKET PROVIDED WITH TURBINE AND METHOD FOR REPLACING THE SAME

CROSS-REFERENCE TO RELATED APPLICATION(S)

This application claims priority to Korean Patent Application No 10-2014-0188544 filed on Dec. 24, 2014 the disclosure of which is incorporated herein by reference in its (their) entirety.

BACKGROUND

Field of the Invention

Exemplary embodiments of the present disclosure relate to a bucket assembly for replacing an old bucket provided with a turbine and a method for replacing the same, and more particularly, to a bucket assembly for replacing an old bucket provided with a turbine and a method for replacing the same capable of easily replacing only a damaged bucket without sequentially disassembling the already installed buckets though a notch opening upon replacing the damaged bucket among the already installed buckets in a tangential entry type dovetail.

Description of the Related Art

Generally, a steam turbine is an apparatus for rotating buckets with blades with high temperature and high pressure steam generated from a large-capacity boiler for a power station to convert heat energy into rotary power which is kinetic energy and is generally divided into a high pressure turbine, an intermediate pressure turbine, and a low pressure turbine to maximize efficiency.

Generally, the steam turbine includes a casing forming an appearance and a frame of the turbine and a rotor rotatably installed in the casing.

Generally, each bucket includes blade parts and dovetails formed at ends of an inside in a radial direction of the blade parts.

Generally, the dovetail may be largely divided into a tangential entry type, an axial entry type, a pinned finger type, and a key axial shape depending on a method for coupling the above-mentioned dovetail with the rotor.

FIG. 1 is a perspective view of a state in which a bucket is coupled with a male dovetail in the existing tangential entry type dovetail.

As illustrated in FIG. 1, a rotor 10 or an outer circumferential surface of a rotor wheel 20 is provided with the male dovetail 30. A portion of the male dovetail 30 is provided with a notch opening 40, such that a plurality of buckets 50 are sequentially inserted in a tangential direction of the rotor through the notch opening 40. Although not illustrated, the final bucket inserted into the notch opening 40 may be additionally coupled with a separate fixing member not to be separated through a gap of the notch opening 40.

Generally, the bucket is eroded by foreign matters or hygroscopic moisture introduced into the casing of the turbine during the operation of the steam turbine. As such, the damaged bucket reduces the efficiency of the turbine and therefore needs to be necessarily replaced.

However, to replace the damaged bucket in the existing tangential entry type dovetail, the already installed bucket as well as the damaged bucket needs to be sequentially disassembled through the notch opening. Even when the damaged bucket is installed near the notch opening 40, the plurality of normal buckets need to be disassembled through the notch opening 40, which causes inconvenience. In addition, to replace the bucket installed at the exact opposite side of the notch opening 40, the bucket corresponding to a half of the total number of buckets coupled with the male dovetail needs to be disassembled through the notch opening 40 and therefore the replacement of the damaged bucket is very uncomfortable.

Further, to replace the damaged bucket in the existing tangential entry type dovetail, the damaged bucket needs to be disassembled through the notch opening, and therefore the replacement time and the replacement costs of the damaged bucket may be increased.

In addition, to replace the damaged bucket in the existing tangential entry type dovetail, the bucket needs to be disassembled through the notch opening in a reverse order to the assembled order. As a result, the rotor or the rotor wheel provided with the male dovetail may be secondarily damaged.

Further, to replace the damaged bucket in the existing tangential entry type dovetail, shroud latching occurs during the process of disassembling the buckets through the notch opening and thus Shroud align is misaligned, thereby reducing the efficiency of the turbine.

PATENT DOCUMENT

Korean Patent Laid-Open Publication No. 10-2004-0009391

SUMMARY

An object of the present disclosure relates to a bucket assembly for replacing an old bucket provided with a turbine and a method for replacing the same capable of removing the bucket to be replaced and then simply assembling the bucket assembly configured of a blade part, first and second dovetail members, and a coupling member in a male dovetail, without sequentially disassembling the already installed buckets through a notch opening upon replacing a damaged bucket among the already installed buckets in a tangential entry type dovetail.

Another object of the present disclosure relates to a bucket assembly for replacing an old bucket provided with a turbine and a method for replacing the same capable of saving replacement time and replacement costs of a damaged bucket and preventing a rotor or a rotor wheel from being damaged and a shroud align from being mismatched, without sequentially disassembling the already installed buckets through a notch opening when a damaged bucket among the already installed buckets is replaced in a tangential entry type dovetail.

Other objects and advantages of the present disclosure can be understood by the following description, and become apparent with reference to the embodiments of the present invention. Also, it is obvious to those skilled in the art to which the present disclosure pertains that the objects and advantages of the present disclosure can be realized by the means as claimed and combinations thereof.

In accordance with one aspect of the present disclosure, a bucket assembly for replacing an old bucket provided with a turbine for replacing a plurality of already installed bucket assemblies sequentially inserted in a tangential direction of a rotor through a notch opening formed at a portion of a male dovetail which is formed at the rotor or an outer circumferential surface of a rotor wheel includes: a blade part; a first dovetail member in which an outside end in a radial direction of the rotor is coupled with an inside end in a radial direction of the blade part; a second dovetail member in which the outside end in the radial direction of the rotor is coupled with the inside end in the radial direction of the blade part in a state in which the second dovetail member faces the first dovetail member; and a coupling member for fastening the first dovetail member with the second dovetail member.

The bucket assembly may further include: a shroud formed at the end in the outside in the radial direction of the blade part.

The first dovetail member may include a first female dovetail formed on an inner side surface of the first dovetail member in a shape corresponding to an outer side surface of the male dovetail and the second dovetail member may include a second female dovetail formed on an inner side surface of the second dovetail member in a shape corresponding to an outer side surface of the male dovetail to face the first female dovetail.

The blade part may include a fastening part formed at the inside end in the radial direction of the blade part to protrude in an inside direction in a radial direction, the first dovetail member may include a first coupling part formed at the outside end in the radial direction of the first dovetail member to correspond to a shape of the fastening part, and the second dovetail member may include a second coupling part formed at the outside end in the radial direction of the second dovetail member to correspond to the shape of the fastening part while facing the first coupling part.

The first dovetail member may include a first through hole horizontally penetrating through the first dovetail member between the first female dovetail and the first coupling part, the second dovetail member may include a second through hole horizontally penetrating through the second dovetail member to communicate with the first through hole between the second female dovetail and the second coupling part, and the coupling member may be inserted to penetrate through the first through hole and the second through hole.

The fastening part may include a first flange and a second flange formed to protrude outwardly from both ends in an axial direction of the rotor, the first coupling part may include a first concave part that is formed on an inner side surface of the first coupling part and is seated with the first flange, and the second coupling part may include a second concave part that is formed on an inner side surface of the second coupling part so that the second flange is seated while facing the first flange.

The coupling member may be formed as a thread pin.

The thread pin may be inserted into the first and second through holes and then both ends thereof may be fixed by caulking.

An outer circumferential surface of the coupling member may be provided with a thread, inner circumferential surfaces of the first through hole and the second through hole may be provided with screw groove corresponding to threads, and the coupling member may be fixed to the first through hole and the second through hole by a screw connection.

Both ends in a tangential direction of the shroud may be formed not to be parallel with the axial direction of the rotor.

The first dovetail member and the second dovetail member may be formed so that inner sides facing each other symmetrical to each other.

In the first dovetail member, a stepped part may be formed at the inside end of the first through hole to be vertically symmetrical to each other based on the insertion direction of the coupling member.

A tip portion of the coupling member inserted into the first through hole may have a shape corresponding to the stepped part.

A length direction of the stepped part may be provided with a thread and the coupling member corresponding to the stepped part may be provided with a screw groove so that the coupling member is screw-connected only in a section in which the stepped part is formed.

The first and second through holes may be opened at a central position based on length directions of the first and second dovetail members or may be each opened at the central position and left and right positions so that the coupling member is inserted.

In accordance with another aspect of the present disclosure, a method for replacing an old bucket provided with a turbine includes: removing a damaged bucket among a plurality of buckets provided in the turbine; disposing a blade part of the bucket assembly for replacing between adjacent normal buckets; seating a first coupling part at one side of a fastening part protruding inwardly from an inside end in a radial direction of the blade part of the bucket assembly for replacing and seating a first female dovetail at one side of a male dovetail to couple a first dovetail member; seating a second coupling part at the other side of the fastening part and seating a second female dovetail at the other side of the male dovetail to couple a second dovetail member with the first dovetail member while facing the first dovetail member; and inserting a coupling member into a first through hole of the first dovetail member and a second through hole of the second dovetail member.

The removing of the damaged bucket may include: cutting the blade part in a horizontal direction; and cutting the blade part in a vertical direction in which a dovetail groove is formed, based on a center of a cut upper surface of the blade part.

In the cutting of the blade part in the horizontal direction, the cutting may be performed at an upper position of the dovetail groove formed in the damaged bucket and may be performed in the horizontal direction at the most adjacent position in the upper direction of the dovetail groove.

The removing of the damaged bucket may include: sucking chips and foreign matters occurring at the time of the cutting after the cutting in the horizontal direction and the cutting in the vertical direction are performed; and washing the position at which the bucket assembly for replacing is mounted after the foreign matters are sucked.

In other exemplary embodiment of a method for replacing an old bucket provided with a turbine according to the present disclosure, the coupling member is formed as a thread pin in the inserting of the coupling member into the first through hole and the second through hole and the thread pin is inserted into the first through hole and the second through hole and then is caulked.

It is to be understood that both the foregoing general description and the following detailed description are exemplary and explanatory and are intended to provide further explanation of the invention as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

Exemplary embodiments will be described in detail with reference to the accompanying drawings.

Figure 1:
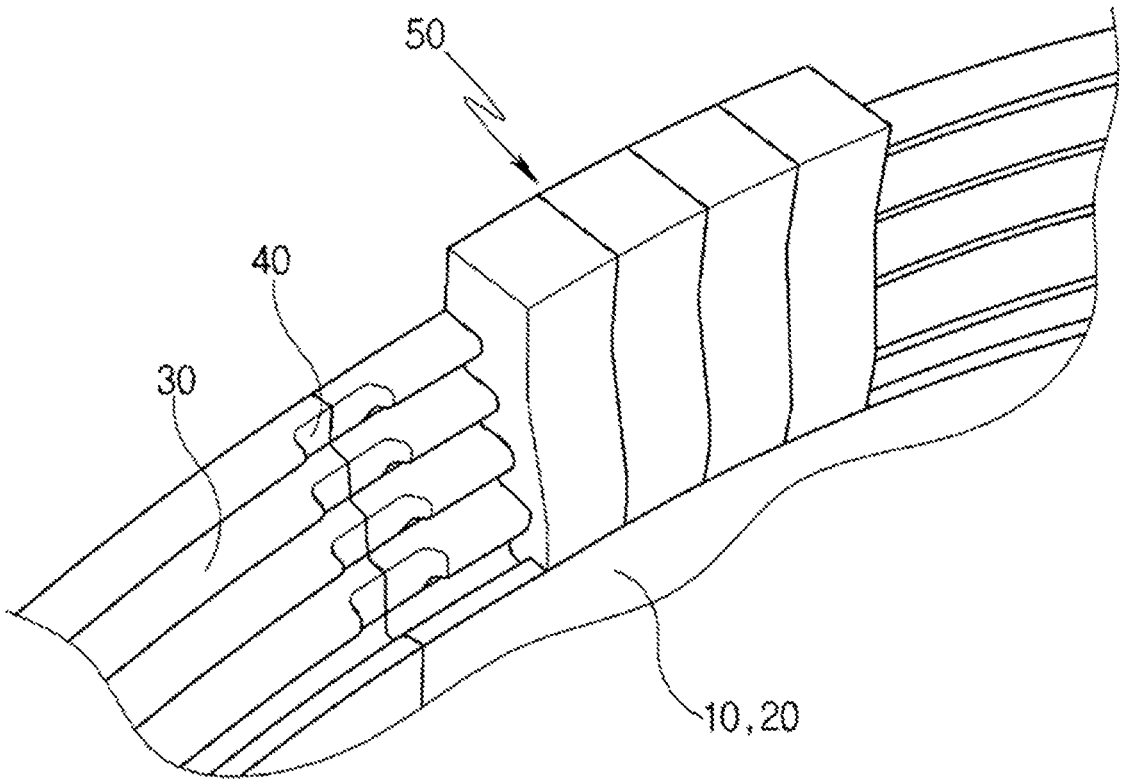
FIG. 1 is a perspective view of a state in which a bucket is coupled with a male dovetail in the existing tangential entry type dovetail.
Figure 2:
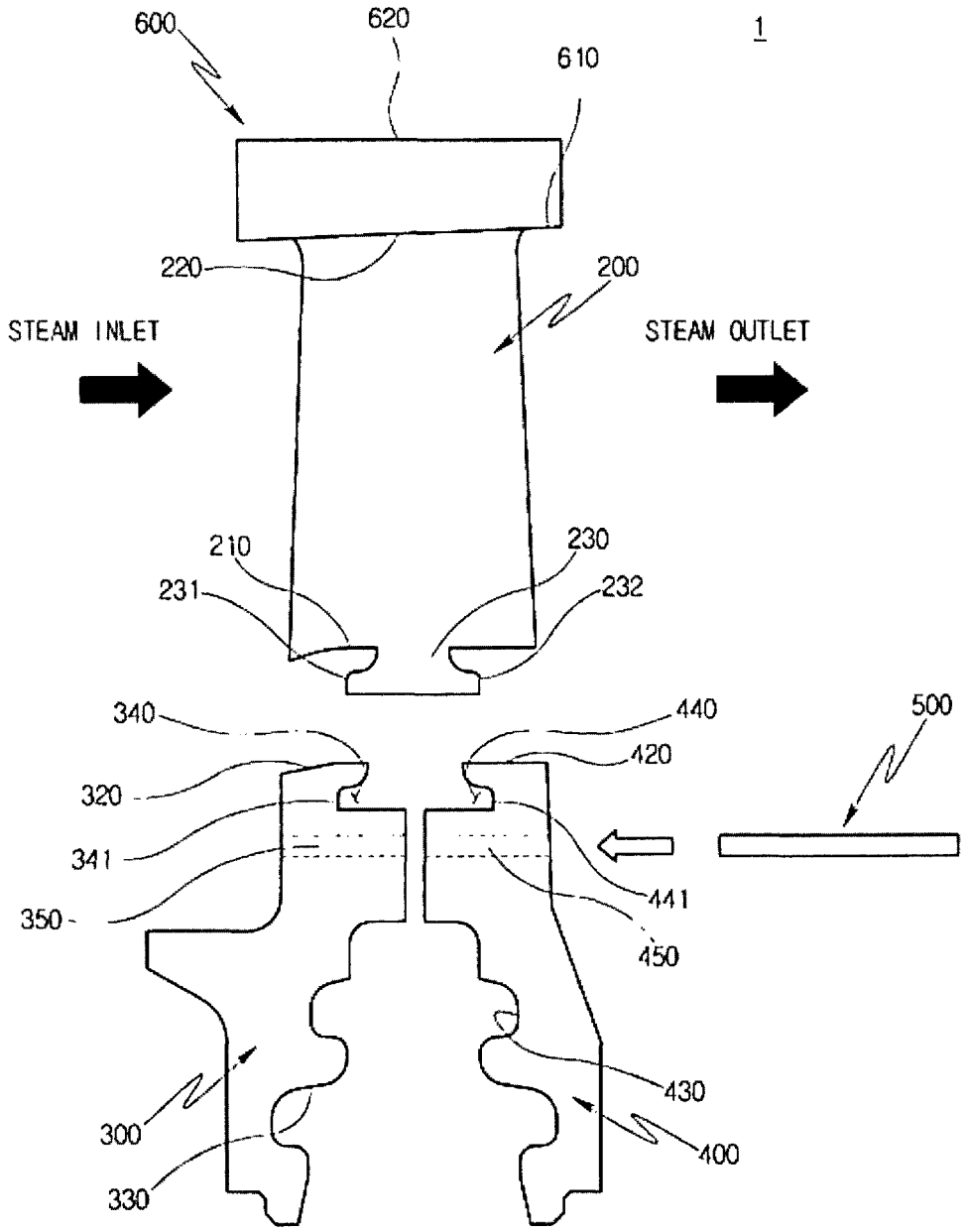
FIG. 2 is an exploded cross-sectional view of a bucket assembly for replacing an old bucket provided with a turbine according to an exemplary embodiment.
Figure 3:
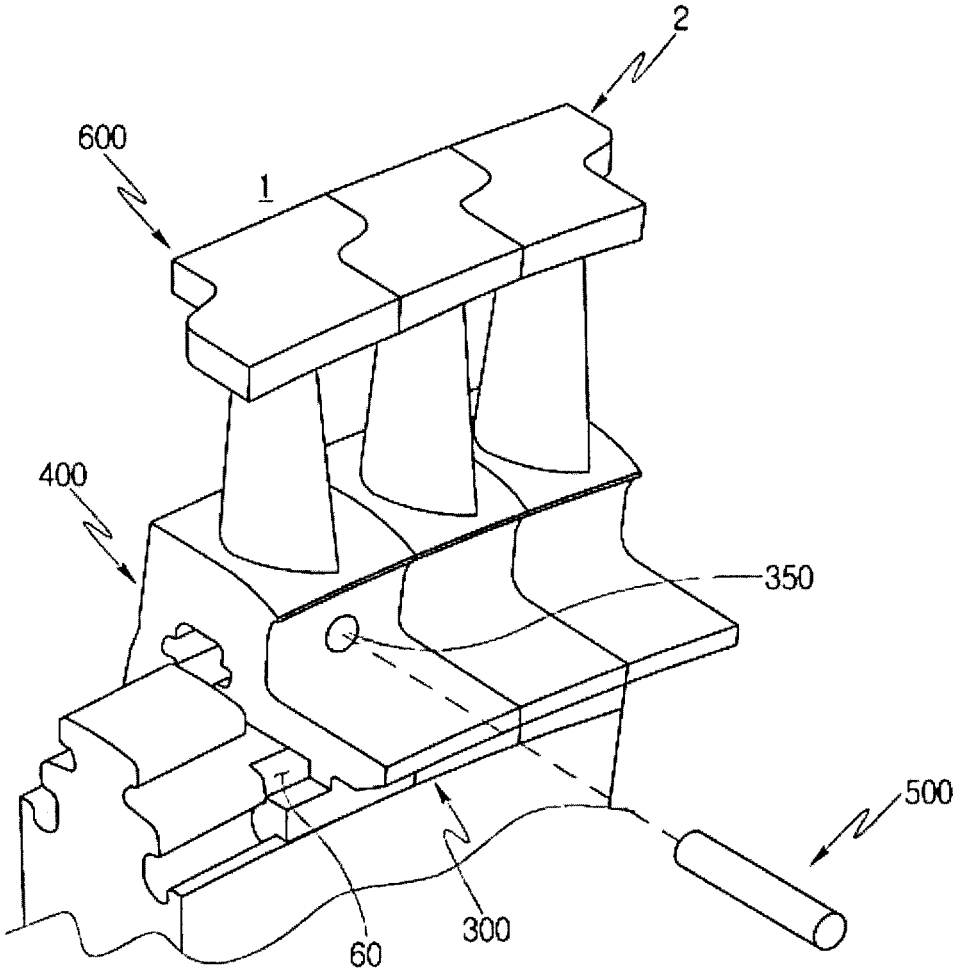
FIG. 3 is a perspective view of the bucket assembly for replacing an old bucket provided with a turbine according to the exemplary embodiment.
Figure 4:
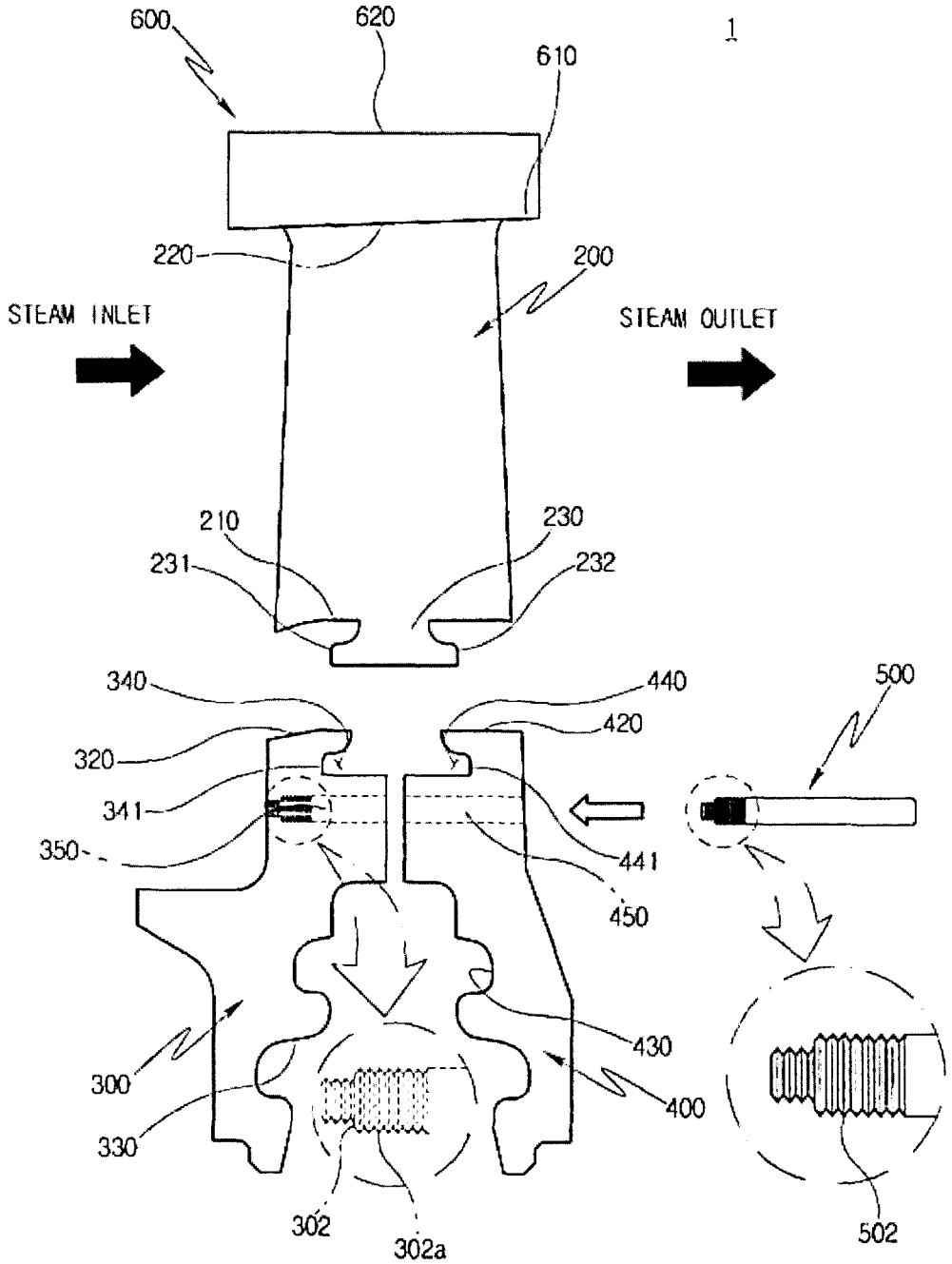
FIG. 4 is a diagram illustrating a stepped part and a coupling member of the bucket assembly for replacing an old bucket provided with a turbine according to the exemplary embodiment.
Figure 5:
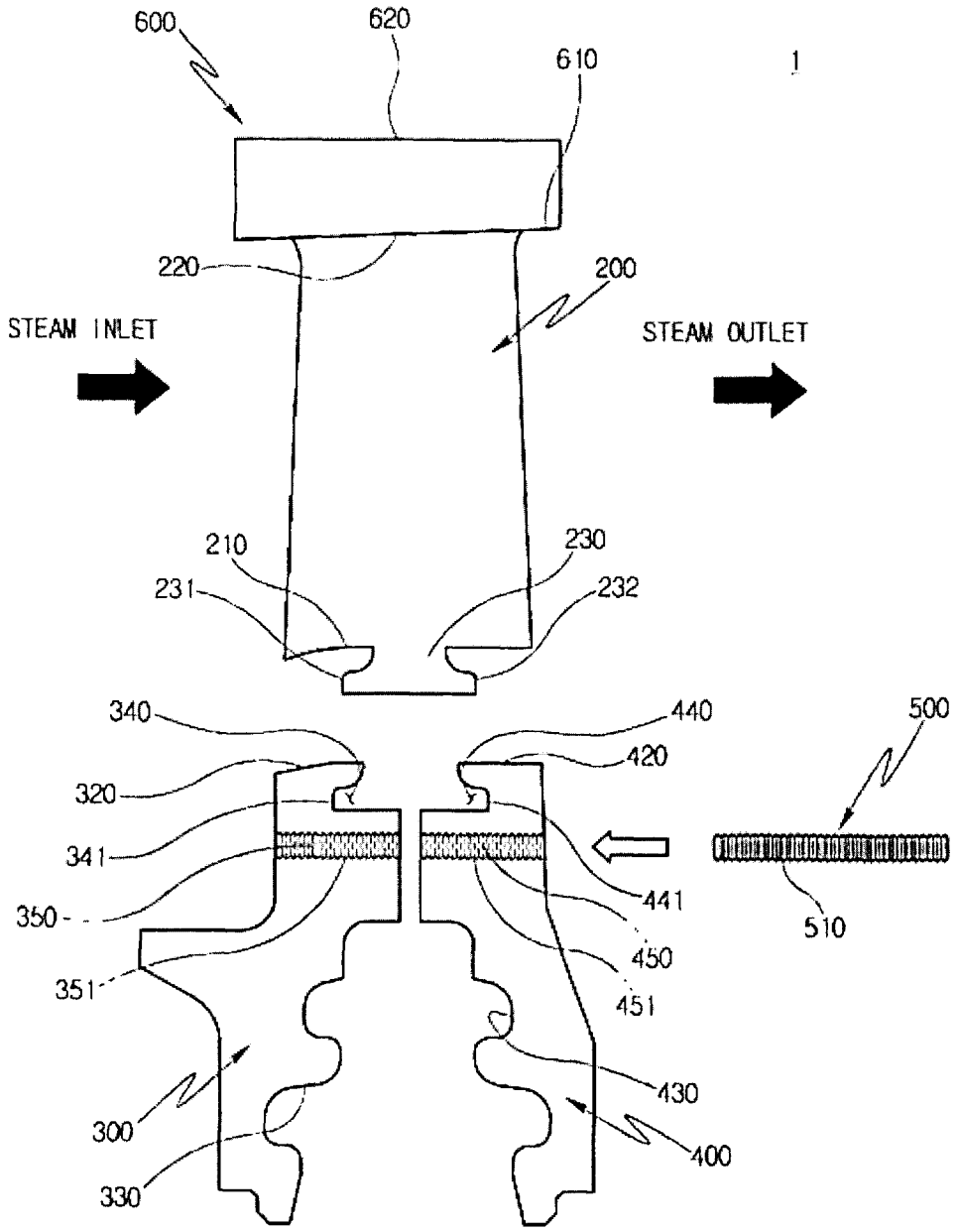
FIG. 5 is an exploded cross-sectional view of a bucket assembly for replacing an old bucket provided with a turbine according to another exemplary embodiment.
Figure 6:
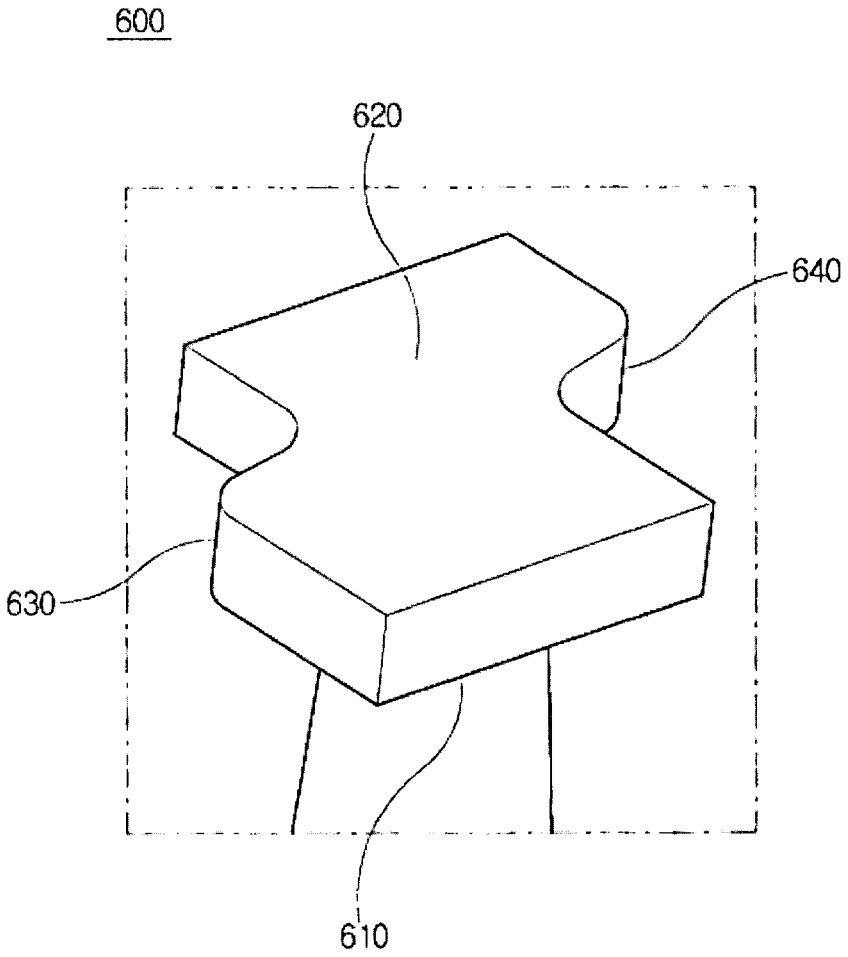
FIG. 6 is a perspective view of a shroud illustrated in FIG. 2.

FIG. 2 is an exploded cross-sectional view of a bucket assembly for replacing an old bucket provided with a turbine according to an exemplary embodiment of the present disclosure, FIG. 3 is a perspective view of the bucket assembly for replacing an old bucket provided with a turbine according to the exemplary embodiment of the present disclosure, FIG. 4 is a diagram illustrating a stepped part and a coupling member of the bucket assembly for replacing an old bucket provided with a turbine according to the exemplary embodiment, FIG. 5 is an exploded cross-sectional view of a bucket assembly for replacing an old bucket provided with a turbine according to another exemplary embodiment, and FIG. 6 is a perspective view of a shroud illustrated in FIG. 2.

As illustrated in FIGS. 2 and 3, a bucket assembly 1 for replacing an old bucket provided with a turbine according to an exemplary embodiment includes a blade part 200, a first dovetail member 300, a second dovetail member 400, and a coupling member 500.

A technical feature of the present disclosure is that the final bucket among a plurality of buckets mounted in a rotor is configured to be separated into 3 pieces to improve workability of a worker depending on the mounting and as a plurality of general buckets 2 adjacently adhering to the final bucket, a bucket in a one body form is mounted and used. For reference, the exemplary embodiment describes that the final buckets is limited to 3 pieces. However, the final bucket is not necessarily limited to 3 pieces but may be variously changed.

The final bucket 1 is provided with general buckets 2 in a circumferential direction, in which the general bucket 2 is not configured of the blade part 200, the first dovetail member 300, the second dovetail member 400, and the coupling member 500 like the final bucket 1 but is configured of the one body form as described above.

If a crack or abnormality occurs in the general bucket located at a specific position and thus the general bucket needs to be replaced, the bucket assembly in which the bucket to be replaced is cut and then is configured of 3 pieces is easily installed at the corresponding position to greatly improve workability and the general buckets adjacent to the bucket to be replaced may be rapidly replaced without being separated one by one.

By doing so, it is possible to stably operate the turbine and improve efficiency by greatly shortening an unnecessary time taken to separate the bucket to be replaced from the general buckets and preventing a damage from occurring upon drawing out the buckets.

The rotor is rotatably installed in a casing. The casing (not illustrated) is coupled to be separated into an upper casing and a lower casing or assembled and thus an inside thereof is provided with the rotor and the bucket assembly, thereby serving to block or protect internal components from external impact elements or foreign matters. The rotor serves as a rotating shaft and both ends of the rotor may be rotatably supported by a bearing.

The rotor wheel may be formed in a circular form or a disk form and a central portion of the rotor wheel is provided with a hollow hole. By this configuration, the rotor is through-coupled with the rotor wheel through the hollow hole, such that the rotor and the rotor wheel may be integrally rotated. A male dovetail may be formed on an outer circumferential surface of the rotor or an outer circumferential surface of the rotor wheel. In the existing dovetail of the bucket inserted in a tangential direction through the notch opening 60 or the bucket assembly 1 to be described below, an outer side surface of the male dovetail is formed to have a shape corresponding to inner side surfaces of a first female dovetail 330 of the first dovetail member 300 and a second female dovetail 430 of the second dovetail member 400 so that the male dovetail is fastened with the first female dovetail 330 and the second female dovetail 430 are fastened.

For example, the outer side surface of the male dovetail is formed so that the curved fastened portions having a fir tree shape are symmetrical to each other based on a virtual central line in an axial direction of the rotor. Similarly, the inner side surfaces of the first female dovetail 330 of the first dovetail member 300 and a second female dovetail 430 of the second dovetail member 400 are formed so that the curved fastened portions having the fir tree shape are symmetrical to each other based on the virtual central line in the axial direction of the rotor. Therefore, the already installed bucket and the bucket assembly for replacing are constrained in the axial direction and the radial direction of the rotor. A portion of the male dovetail is provided with the notch opening. A portion of the male dovetail formed on the outer circumferential surface of the rotor or the outer circumferential surface of the rotor wheel is provided with the notch opening so that both ends in a tangential direction of the male dovetail are relatively concave. The notch opening serves to insert the bucket into the rotor or the rotor wheel in the radial direction to move the buckets inserted into the rotor or the rotor wheel to an original position along the male dovetail. That is, the notch opening serves to install the buckets in the male dovetail of the rotor or the rotor wheel in a tangential entry dovetail.

The plurality of buckets are sequentially inserted in the tangential direction of the rotor through the notch opening. After all the buckets are installed along the tangential direction of the male dovetail, a final bucket generally called a closed bucket is installed in the notch opening.

Although not necessarily limited thereto, the above-mentioned closed bucket has a shape different from that of the dovetails of other buckets inserted into the notch opening and the closed bucket may be additionally provided with a coupling member to prevent the closed bucket from being separated from the notch opening.

As described above, the plurality of buckets sequentially inserted in the tangential direction of the rotor through the notch opening and the closed bucket finally installed in the notch opening are aged due to the operation of the turbine or may be damaged due to foreign matters or hygroscopic moisture.

The present disclosure relates to the bucket assembly for replacing an old bucket provided with a turbine capable of replacing the damaged bucket.

The bucket assembly 1 for replacing an old bucket provided with a turbine according to the exemplary embodiment of the present disclosure includes the blade part 200, the first dovetail member 300, the second dovetail member 400, and the coupling member 500.

The blade part 200 serves to accept steam generated from a boiler to convert fluid energy of the steam, that is, heat energy and velocity energy into rotary power which is mechanical energy. Although not necessarily limited thereto, the blade part 200 has cross section shapes such as crescent moon and airfoil and when a fluid passes through the blade part 200, generates lift, etc., to increase the velocity energy of the fluid, thereby increasing the rotary power.

In the first dovetail member 300, an outside end 320 in the radial direction of the rotor is coupled with an inside end 210 in the radial direction of the blade part 200. For convenience, the first dovetail member 300 is called the dovetail member fastened with the male dovetail to be from a steam inlet toward a steam outlet (if the first dovetail member is fastened with the male dovetail to be from the steam outlet toward the steam inlet, the dovetail coupled with the male dovetail to be faced therewith becomes the second dovetail member). The outside end 420 in the radial direction of the rotor of the second dovetail member is coupled with the inside end 210 in the radial direction of the blade part so that the second dovetail member 400 faces the first dovetail member 300.

The coupling member 500 serves to fasten the first dovetail member 300 with the second dovetail member 400 to prevent the first dovetail member 300 and the second dovetail member 400 from being separated during the operation of the turbine.

As such, according to the exemplary embodiments of the present disclosure, the bucket to be replaced is removed and then the bucket assembly 1 configured of the blade part 200, the first and second dovetail members 200 and 300, and the coupling member 500 is simply assembled in the male dovetail, without sequentially disassembling the already installed buckets through the notch opening upon replacing the damaged bucket among the already installed buckets in the tangential entry type dovetail, thereby saving replacement costs and replacement time of the damaged bucket.

As illustrated in FIGS. 2 and 4, the first dovetail member 300 includes the first female dovetail 330 and the second dovetail member 400 includes the second female dovetail 430.

The first female dovetail 330 is formed at the inner side surface of the first dovetail member 300 to have a shape corresponding to the outer side surface of the male dovetail.

The first dovetail member 300 and the second dovetail member 400 are formed so that the inner sides facing each other are symmetrical to each other, and therefore when the coupling member 500 to be described below is inserted into first and second through holes 350 and 450, a gap does not occurs and an adhering state is stably maintained.

The second female dovetail 430 is formed at the inner side surface of the second dovetail member 400 while facing the first female dovetail 330 to have a shape corresponding to the outer side surface of the male dovetail.

The female dovetail 330 and the second female dovetail 430 are preferably designed to well stand a centrifugal stress when the bucket assembly 1 is rotated. As described above, the first female dovetail 330 and the second female dovetail 430 may be formed to have a ripple shape.

The first dovetail member 300 and the second dovetail member 400 are each provided with a protruding piece (not illustrated) protruding outwardly from any one of opposite surfaces facing each other and the other opposite surface facing the protruding piece may be provided with an insertion part (not illustrated) into which the protruding piece is inserted. In this case, the protruding piece may be formed in the first dovetail member 300 and the insertion part may be formed in the second dovetail member 400. However, the positions of the protruding piece and the insertion part may be changed and therefore are not particularly limited.

The protruding piece is formed in any one of a rectangular parallelepiped, a cross shape, a polygonal shape, and a disc shape and the insertion part is formed in a shape corresponding to the protruding piece, such that the adhering state therebetween may more stably maintained while the first dovetail member 300 and the second dovetail member 400 is separated from each other or coupled with each other.

According to the exemplary embodiment of the present disclosure, the blade part 200 and a shroud 600 of the bucket assembly 1 may be formed integrally.

The blade part 200 is further provided with a fastening part 230 that is positioned at a center of a bottom surface and protrudes toward top surfaces of the first dovetail member 300 and the second dovetail member 400, the first dovetail member 300 further includes a first coupling part 340 formed at a position at which it faces the fastening part 230, and the second dovetail member 400 further includes a second coupling part 440 formed at a position at which it faces the fastening part 230.

The fastening part 230 is formed to protrude outwardly from both ends in the axial direction of the rotor and a shape thereof is formed in a bilateral symmetry form.

The first coupling part 340 is formed at the outside end 320 in the radial direction of the first dovetail member 300 to correspond to the shape of the fastening part 230.

The second coupling part 440 is formed at the outside end 420 in the radial direction of the second dovetail member 400 while facing the first coupling part 340 to correspond to the shape of the fastening part 230.

That is, as the fastening part 230 is block-coupled with the first coupling part 340 and the second coupling part 440 in the state in which it adheres to the first coupling part 340 and the second coupling part 440, the blade part 200 is easily coupled with the first dovetail member 300 and the second dovetail member 400.

The fastening part 230 of the blade part 200 includes a first flange 231 and a second flange 232, the first coupling part 340 of the first dovetail member 300 includes a first concave part 341, and the second coupling part 440 of the second dovetail member 400 includes a second concave part 441.

The first flange 231 and the second flange 232 are formed to protrude outwardly from both ends in a tangential direction of the fastening part 230.

The first concave part 341 is formed on the inner side surface of the first coupling part 340 and is coupled with the first flange 231 in the state in which it adheres to the first flange 231.

The second concave part 441 is formed on the inner side surface of the second coupling part 440 to face the first flange 231 and is coupled with the second flange 232 in the state in which it adheres to the second flange 232.

As such, to primarily couple the blade part 200 with the first and second dovetail members 300 and 400, the fastening part 230 is block-coupled with the first and second coupling parts 340 and 440 and the first flange 231 is secondarily seated in the first concave part 341 in the state in which it adheres to the first concave part 341 and the second flange 232 is coupled with the second concave part 441 in the state in which it adheres to the second concave part 441.

As such, as the blade part 200 is firmly coupled with the first and second dovetail members 300 and 400 doubly, the blade part 200 may be prevented from being separated from the first dovetail member 300 and the second dovetail member 400 during the operation of the turbine (rotation of the rotor), such that the fixed stability to the first and second dovetail members 300 and 400 may be improved, thereby finally improving the efficiency of the turbine.

When viewed from the front based on the drawing, the first dovetail member 300 includes the first through hole 350 formed at a lower portion of the first coupling part 340 and the second dovetail member 400 includes the second through hole 450 formed at a lower portion of the second coupling part 440.

In more detail, the first through hole 350 horizontally penetrates through the first dovetail member 300 to be formed between the first female dovetail 330 and the first coupling part 340.

The second through hole 450 penetrates through the second dovetail member 400 to communicate with the first through hole 350 to be formed between the second female dovetail 430 and the second coupling part 340.

That is, the first through hole 350 and the second through hole 450 are formed to axially penetrate through the first dovetail member 300 and the second dovetail member 400 so that they are each positioned on the same axial line in the state in which they are coupled with the first dovetail member 300 and the second dovetail member 400.

The coupling member 500 is inserted to penetrate through the first through hole 350 and the second through hole 450 and may be formed as, for example, a thread pin. Further, after the thread pin is inserted into the first through hole 350 and the second through hole 450, both ends in an axial direction of the thread pin are fixed to the first through hole 350 and the second through hole 450 by caulking.

That is, the thread pin is inserted into the first through hole 350 and the second through hole 450, the first dovetail member 300 and the second dovetail member 400 are coupled with each other in the adhering state while the thread pin is fixed to the first and second through holes 350 and 360 by the caulking that plastically deforms both ends of the thread pin or the ends of the first through hole 350 and the second through hole 450, and the first and second dovetail members 300 and 400 are prevented from being separated in the axial direction.

As the thread pin is fixed to the first through hole 350 and the second through hole 360 by the caulking, the phenomenon that the coupling member 500 is separated from the bucket assembly 1 during the operation of the turbine is prevented.

Referring to FIG. 4, the first dovetail member 300 is formed so that a stepped part 302 is vertically symmetrical at the inside end of the first through hole 350 based on a direction in which the coupling member 500 is inserted and the position of the stepped part 302 is formed at a left end based on the first through hole 350 in the drawing.

A tip portion of the coupling member 500 inserted into the first through hole 350 has a shape corresponding to the stepped part 302 and therefore when the coupling member 500 is inserted into the first through hole 350, the insertion position is accurately guided.

Further, when a worker inserts the coupling member 500 into the first and second through holes 350 and 450 and then performs the caulking, he/she first performs the caulking on the right end of the coupling member 500 located at the second through hole 450. In this case, the left end of the coupling member 500 is supported to the stepped part 302 and therefore the position of the coupling member 500 is stably fixed without being changed while the caulking is performed on the right end of the coupling member 500.

Therefore, when a working space of the worker is narrow or when the caulking working is performed through the accurate insertion of the coupling member 500, the worker may easily perform the working without separate difficulty. By doing so, the workability and the working efficiency of the worker are improved and the coupling force of the first and second dovetail members 300 and 400, such that the fixed stability of the blade part 200 may be improved by the coupling member 500.

The stepped part 302 is formed in a relatively smaller diameter than that of the coupling member 500 and when the coupling member 500 is inserted, is formed at the left end in the section in which the diameter is reduced by a predetermined length in the horizontal direction.

The stepped part 302 according to the exemplary embodiment of the present disclosure is provided with a thread 302*a* and the coupling member 500 corresponding to the stepped part 302 is provided with a screw groove 502, such that the coupling member 500 is screw-connected only in the section in which the stepped part 302 is formed.

The thread 302*a* is limited formed only in the section illustrated in the drawing and may be formed in a spiral shape or may be changed in other shapes.

To couple the coupling member 500 with the stepped part 302, the worker performs the installation working by inserting the coupling member 500 into the first and second through holes 350 and 450 by a predetermined length and then rotating it clockwise to couple the screw groove 502 with the thread 302*a*.

The first and second through holes 350 and 450 are opened at a central position based on length directions of the first and second dovetail members 300 and 400 or are each opened at the central position and left and right positions so that the coupling member 500 is inserted. Positioning the insertion position of the coupling member 500 at the center may improve the fixed stability and the coupling force between the blade part 200 and the first and second dovetail members 300 and 400.

The coupling member 500 may be inserted into the left and right sides, respectively, based on the center in addition to the foregoing position. In this case, the number of coupling members 500 is increased and thus the fixed force depending on the insertion into the first and second through holes 350 and 450 is increased, such that the fixed force of the first and second dovetail members 300 and 400 and the blade part 200 is improved, thereby preventing the separation due to the vibration.

Referring to FIG. 5, the coupling member 500 according to another exemplary embodiment of the present disclosure includes a thread 510 formed on the outer circumferential surface and the third through hole 350 and the second through hole 450 are each provided with screw grooves 351 and 451.

The thread 510 is formed on the outer circumferential surface of the coupling member 500 along an axial direction and the inner circumferential surface of the first through hole 350 is provided with the screw groove 351 corresponding to the thread and the inner circumferential surface of the second through hole 450 is also provided with the screw grove 451 corresponding to the thread.

The thread 510 of the coupling member 500 and the screw grooves 351 and 451 formed on the first and second through holes 350 and 450 firmly couples the first dovetail member 300 with the second dovetail member 400 by screw connection. Therefore, the first and second dovetail members 300 and 400 are prevented from being separated in the axial direction.

As described above, according to the exemplary embodiment of the present disclosure, the damage secondarily occurring to the rotor or the rotor wheel during the disassembling process of the bucket is minimized without sequentially disassembling the already installed buckets through the notch opening upon replacing the damaged bucket among the already installed buckets to save the maintenance costs of the rotor and the rotor wheel and reducing the occurrence of shroud latching to maintain the shroud alignment, thereby preventing the efficiency of the turbine from reducing.

Referring to FIG. 6, the bucket assembly 1 for replacing an old bucket provided with a turbine according to an exemplary embodiment of the present disclosure further includes the shroud 600 and the shroud 600 is provided at the outside end 220 in the radial direction of the blade part 200. The shroud 600 serves to prevent steam leakage and reduce vibration.

Both ends 630 and 640 in a tangential direction of the shroud are formed not to be parallel with a surface corresponding to the axial direction of the rotor, that is, the rotation direction of the rotor and the reverse direction thereof. The shroud 600 may have a Z-letter shape or a V-letter shape when viewed from the outside in the radial direction and may be changed in various forms if necessary. Reference numerals 610 and 620 represents an inside end 610 and an outside end 620 in a radial direction of the shroud 600.

Figure 7:
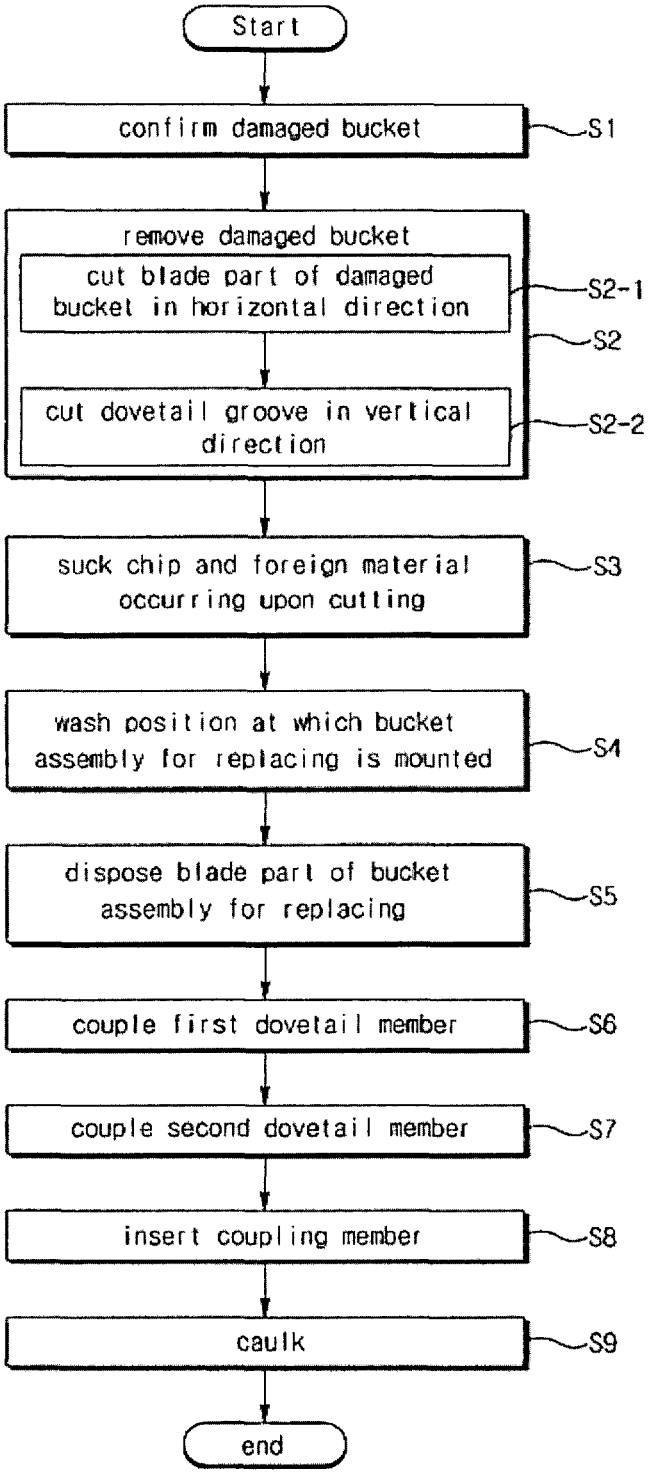
FIG. 7 is an assembling flow chart of a method for replacing an old bucket provided with a turbine according to an exemplary embodiment.

FIG. 7 is an assembling flow chart of a method for replacing an old bucket provided with a turbine according to an exemplary embodiment of the present disclosure. As illustrated in FIG. 7, the method for replacing an old bucket provided with a turbine according to the exemplary embodiment of the present disclosure includes confirming the damaged bucket among the plurality of buckets provided in the turbine (S1); removing the damaged bucket (S2); disposing the blade part of the bucket assembly for replacing between the adjacent normal buckets (S3); seating the first coupling part at one side of the fastening part protruding inwardly from the inside end in the radial direction of the blade part of the bucket assembly for replacing and seating the first female dovetail at one side of the male dovetail to couple the first dovetail member (S4); seating the second coupling part at the other side of the fastening part and seating the second female dovetail at the other side of the male dovetail to couple the second dovetail member with the first dovetail member while facing the first dovetail member (S5); and inserting the coupling member into the first through hole of the first dovetail member and the second through hole of the second dovetail member (S6).

To confirm the damaged bucket (S1), it is confirmed whether the bucket 2 installed in the tangential direction to the male dovetail of the outer circumferential surfaces of the rotor or the rotor wheel is damaged by an electromagnetic generator or an ultrasonic generator, an analysis program depending on data, various kinds of gauges, etc. It may be confirmed that the already installed bucket is damaged even by a worker's eyes within the regular disassembling time of the turbine.

Figure 8:
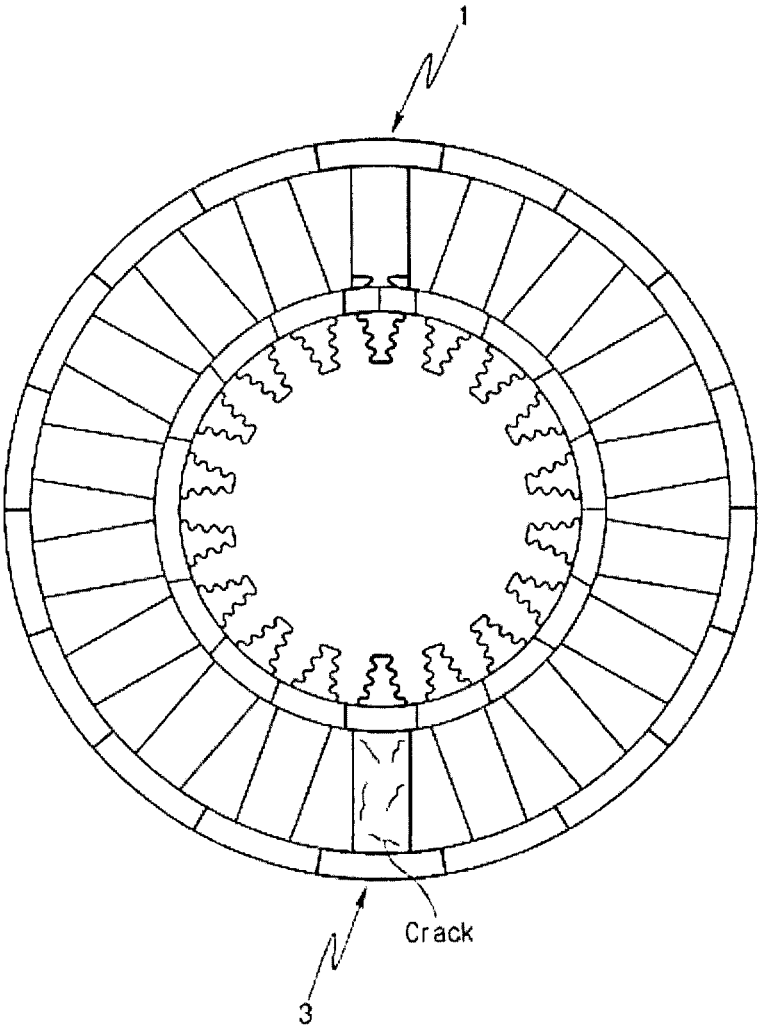
FIGS. 8 to 10 are use state diagrams of the bucket assembly provided with a turbine according to the exemplary embodiment.
Figure 9:
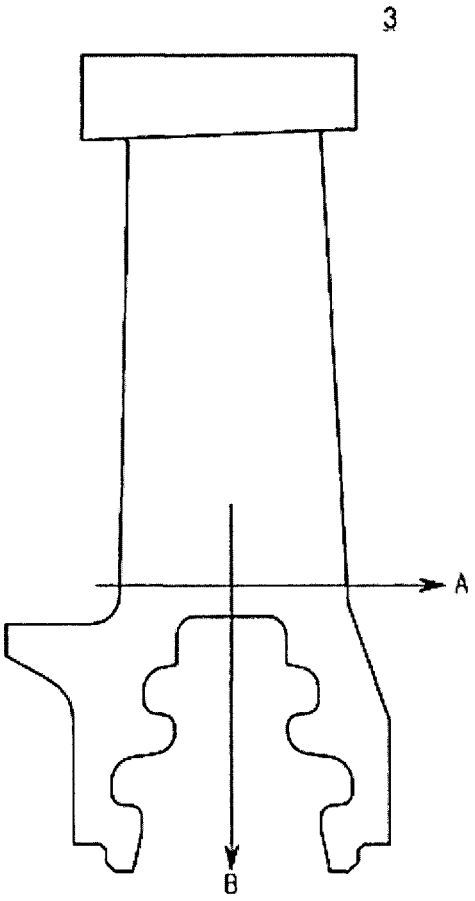
Figure 10:
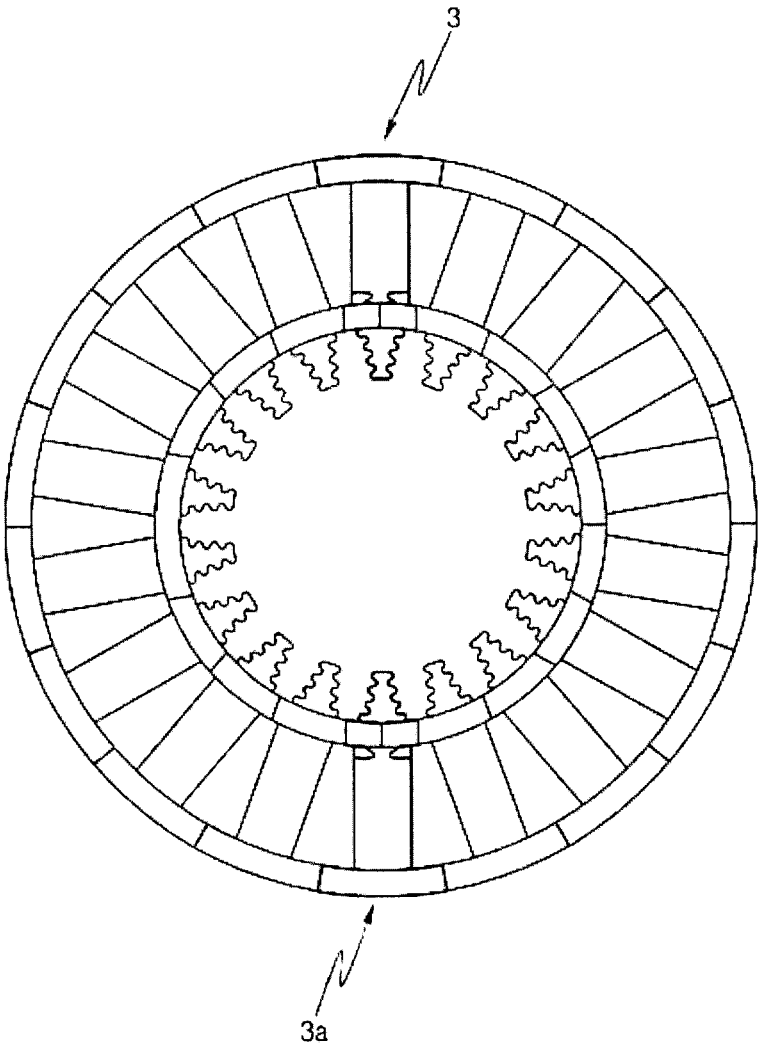

Referring to FIGS. 8 to 10, after the confirming of the damaged bucket (S1), the already damaged bucket 3 is removed (S2) and the damaged bucket 3 is not configured of 3 pieces like the final bucket 1 and is configured in a single configuration in a one-body form.

In this case, the worker separates the damage bucket 3 using a separate tool (not illustrated) while the normal bucket is left at adjacent positions along a circumferential direction to replace the damaged bucket 3 as it is. The meaning of the separation corresponds to the case in which the plurality of adjacent normal buckets disposed in the circumferential direction of the rotor are not sequentially separated but are cut at the place where the damaged bucket is positioned to be drawn out to the outside (S2-1). For example, the worker cuts the blade part in a horizontal direction (A direction) independent of the position to easily perform the working for replacing the damaged bucket. In this case, in the normal bucket, the portions where the blade part and the dovetail groove are formed are integrally manufactured, and therefore the cutting is performed at the lowermost position based on the length direction of the blade part of the normal bucket.

For example, the cutting is horizontally performed at the most adjacent position in the upper direction of the dovetail groove. The reason is that the cutting needs to be performed in the vertical direction (B direction) of the damaged bucket 3 by the subsequent cutting process to maximally shorten make the cut length in the vertical direction so as to prevent the cut length from unnecessarily increasing, thereby simultaneously improving the working speed and the workability.

The cutting tool used by the worker is various and therefore is not particularly limited. Therefore, a handy cutter or a separate cutting machine that may be held by the worker on the spot may be used.

As such, after the horizontal cutting (S2-1) is performed on the blade part, the cutting is performed in the vertical direction in which the dovetail groove is formed based on the center of the upper surface at which the blade part is cut (S2-2).

When the worker performs the cutting on the damaged bucket 3 in the vertical direction, performing the cutting at the center of the upper surface of the blade part may minimize the cut length in the vertical direction, thereby reducing the workload of the worker and the generation amount of the chip upon the cutting.

The worker performs the cutting working on the damaged bucket 3 both in the horizontal direction and the vertical direction as described above and then performs the suction working on foreign matters to remove chips and foreign matters occurring upon the cutting (S3). The chips occur during the cutting working and a large amount of chips occurs by performing the cutting on the damage bucket 3 in the horizontal direction and the vertical direction. Further, the foreign matters occur due to the stacking of various kinds of dusts and particulates while the damaged bucket 3 is used for a long period of time and therefore the installation surface may be managed to be cleaned when the cutting is performed after the suction working is performed.

The worker performs the removal working on foreign matters as described above and then the washing working is performed on the position at which the bucket assembly for replacing is mounted (S4). In the case of the washing working, a cleaner or water may be used.

Further, the worker may perform washing by wiping off portions where foreign matters remain or polluted portions using cloth. In this case, to more efficiently wash the foreign matters, a small amount of cleaner may be used.

After the damaged bucket 3 is removed (S2), the blade part 200 of the bucket assembly for replacing is disposed between the already installed adjacent buckets.

After the disposing of the blade part of the bucket assembly for replacing (S4), the first coupling part 340 of the first dovetail member is seated at one side in the tangential direction of the fastening part 230 protruding inwardly from the inside end 210 in the radial direction of the blade part of the bucket assembly for replacing and the first female dovetail 330 is seated at one side of the male dovetail, thereby coupling the first dovetail member 300 with the blade part and one side in the axial direction of the male dovetail.

After the coupling of the first dovetail (S6), the second coupling part 440 of the second dovetail member 400 is seated at the other side in the tangential direction of the fastening part 230 and the second female dovetail 430 is seated at the other side of the male dovetail and thus the second dovetail member 400 is coupled with the blade part and the other side in the axial direction of the male dovetail to face the first dovetail member.

As illustrated in FIGS. 2 and 4, when the first and second flanges 231 and 232 protruding outwardly from both ends in the tangential direction of the fastening part 230 are formed, the fastening part 230 is coupled with the first coupling part 340 to be seated in the state in which the first flange 231 is seated in the first concave part 341 of the first coupling part 340. Further, the fastening part 230 is coupled with the second coupling part 440 to be seated in the state in which the second flange 232 is seated in the second concave part 441.

After the coupling of the second dovetail member (S7), the coupling member 500 is inserted into the first through hole 350 of the first dovetail member 300 and the second through hole 450 of the second dovetail member 400. In this case, as illustrated in FIG. 3, when the thread 510 is formed on the outer circumferential surface of the coupling member 500 in the axial direction, the coupling member is rotate to couple the screw grooves 351 and 451 formed to correspond to the thread with the inner circumferential surfaces of the first through hole 350 and the second through hole 450.

When the coupling member 500 is formed as the thread pin, after the inserting of the coupling member, both ends of the thread pin are caulked to fix the thread pin to the first through hole and the second through hole and the caulking is performed on the left and right ends of the coupling member 500 (S9) to fix the replacement bucket 3*a*.

As such, according to the method for replacing an old bucket provided with a turbine according to the exemplary embodiment the bucket to be replaced is removed and then the bucket assembly configured of the blade part, the first and second dovetail members, and the coupling member is simply assembled in the male dovetail, without sequentially disassembling the already installed buckets through the notch opening upon replacing the damaged bucket among the already installed buckets in the tangential entry type dovetail, thereby shortening the replacement time and the replacement costs of the bucket assembly, preventing the secondary damage occurring to the rotor or the rotor wheel, and preventing the latching phenomenon of the shroud.

According to the exemplary embodiments of the present disclosure, it is possible to save the replacement costs and the replacement time of the damaged bucket by removing the bucket to be replaced and then simply assembling the bucket assembly configured of the blade part, the first and second dovetail members, and the coupling member in the male dovetail, without sequentially disassembling the already installed buckets through the notch opening upon replacing the damaged bucket among the already installed buckets in the tangential entry type dovetail.

Further, according to the exemplary embodiment of the present disclosure, since the already installed buckets needs not be sequentially disassembled through the notch opening upon replacing the damaged bucket among the already installed buckets, the damage secondarily occurring to the rotor or the rotor wheel during the disassembling process of the bucket may be minimized, thereby saving the maintenance costs of the rotor and the rotor wheel and increasing the life expectancy of the turbine.

Further, according to the exemplary embodiment of the present disclosure, since the already installed buckets needs not be sequentially disassembled through the notch opening upon replacing the damaged bucket among the already installed buckets, the occurrence of the shroud latching may be reduced during the disassembling or replacement process of the bucket to maintain the shroud align, thereby preventing the efficiency of the turbine from reducing.

Although the present disclosure was described above with reference to exemplary embodiments, it should be understood that the present disclosure may be changed and modified in various ways by those skilled in the art, without departing from the spirit and scope of the present invention described in claims.

What is claimed is:

1. A bucket assembly for use in replacing an old bucket of a turbine among a plurality of installed bucket assemblies sequentially inserted in a tangential direction of a rotor through a notch opening formed in a male dovetail of the rotor, the bucket assembly comprising:

a blade part having an inside end with respect to a radial direction of the rotor;

a first dovetail member having an outside end with respect to the radial direction of the rotor and including a first coupling part formed at the outside end of the first dovetail member and configured to be coupled with the inside end of the blade part, an inner side surface in which a first female dovetail is formed in a shape corresponding to the male dovetail of the rotor, a first through hole penetrating the first dovetail member at a location between the first female dovetail and the first coupling part, and a stepped part formed at an outer end of the first through hole in an axial direction of the rotor, the stepped part having an inner circumference communicating with a concentric through hole that communicates with the outer end of the first through hole;

a second dovetail member having an outside end in the radial direction of the rotor and including a second coupling part formed at the outside end of the second dovetail member and configured to be coupled with the inside end of the blade part in a state in which the second dovetail member faces the first dovetail member, an inner side surface in which a second female dovetail facing the first female dovetail is formed in a shape corresponding to the male dovetail of the rotor, and a second through hole penetrating the second dovetail member at a location between the second female dovetail and the second coupling part and aligning with the first through hole; and a coupling member configured to be inserted into the first through hole through the second through hole in order to fasten the first dovetail member with the second dovetail member, the coupling member including a tip portion configured to be inserted into the first through hole and to engage with the stepped part.

2. The bucket assembly of claim 1, further comprising:

a shroud formed at an outside end of the blade part, the shroud including first and second uneven end surfaces respectively disposed at opposite sides of the shroud in a tangential direction of the rotor.

3. The bucket assembly of claim 1, wherein the blade part includes a fastening part protruding inwardly in the radial direction of the rotor from the inside end of the blade part.

4. The bucket assembly of claim 3, wherein the fastening part includes a first flange and a second flange formed to protrude outwardly from both ends in an axial direction of the rotor, the first coupling part includes a first concave part that is formed on an inner side surface of the first coupling part and is seated with the first flange, and the second coupling part includes a second concave part that is formed on an inner side surface of the second coupling part so that the second flange is seated while facing the first flange.

5. The bucket assembly of claim 1, wherein the coupling member is a threaded pin.

6. The bucket assembly of claim 5, wherein the threaded pin is configured to be inserted into the first and second through holes.

7. The bucket assembly of claim 1, wherein an outer circumferential surface of the coupling member is provided with a thread, inner circumferential surfaces of the first through hole and the second through hole are provided with screw groove corresponding to the thread, and the coupling member is fixed to the first through hole and the second through hole by a screw connection.

8. The bucket assembly of claim 1, wherein the first dovetail member and the second dovetail member are formed so that inner sides facing each other are symmetrical to each other.

9. The bucket assembly of claim 1, wherein the tip portion of the coupling member inserted into the first through hole has a shape corresponding to the stepped part.

10. The bucket assembly of claim 1, wherein the stepped part includes a threaded internal surface, and the coupling member includes a threaded outer surface corresponding to the stepped part so that the coupling member is screw-connected in a section in which the stepped part is formed.

11. A method for replacing a bucket provided with a turbine, comprising:

removing a damaged bucket from among a plurality of buckets provided in the turbine;

first cutting a blade part of the damaged bucket in a horizontal direction following a horizontal line through the blade part of the damaged bucket adjacent to a dovetail groove of the blade part of the damaged bucket;

second cutting the blade part of the damaged bucket in a vertical direction toward the dovetail groove, the second cutting beginning at a center of the horizontal line of the first cutting;

disposing a blade part of a replacement bucket assembly between adjacent normal buckets;

seating a first coupling part at one side of a fastening part protruding inwardly from an inside end in a radial direction of the blade part of the replacement bucket assembly and seating a first female dovetail at one side of a male dovetail to couple a first dovetail member thereto;

seating a second coupling part at the other side of the fastening part and seating a second female dovetail at the other side of the male dovetail to couple a second dovetail member with the first dovetail member while facing the first dovetail member; and inserting a coupling member into a first through hole of the first dovetail member and a second through hole of the second dovetail member.

12. The method of claim 11, further comprising:

removing chips and foreign matter resulting from the first and second cutting; and washing, after the chips and the foreign matter are removed, a position at which the replacement bucket assembly is to be mounted.

13. The method of claim 11, wherein the coupling member is a thread pin, and the thread pin is inserted into the first through hole and the second through hole and is caulked after being inserted into the first through hole and the second through hole.

* * * * *